United States Patent [19]

Krause

[11] 4,163,872

[45] Aug. 7, 1979

[54] SECRET PULSE SIGNALING SYSTEM

[75] Inventor: Ernst H. Krause, Cheverly, Md.

[73] Assignee: The United States of America as represented by the Secretary of the Navy, Washington, D.C.

[21] Appl. No.: 602,148

[22] Filed: Jun. 28, 1945

[51] Int. Cl.[2] ..... H04K 1/10

[52] U.S. Cl. ..... 179/1.5 R; 179/15 AP

[58] Field of Search ..... 179/15 P, 1.5 R, 15 AP; 250/6.41

[56] References Cited

U.S. PATENT DOCUMENTS

| | | | |
|---|---|---|---|
| 1,573,983 | 2/1926 | Mathes | 179/15 AP |
| 1,632,099 | 6/1927 | Schelleng | 179/1.5 R |

*Primary Examiner*—Howard A. Birmiel

*Attorney, Agent, or Firm*—R. S. Sciascia; Philip Schneider

EXEMPLARY CLAIM

1. A radio pulse signalling system comprising, oscillator means generating a first timing wave which is comprised of a controlled number of cycles, means transmitting a pulse signal at the start of said timing wave, means transmitting a selectable number of pulse signals in response to only certain of said cycles in said timing wave so as to thereby convey the intelligence of transmission, means transmitting a pulse signal in response to a random number of the remaining cycles in said timing wave so as to thereby dissemble the intelligence of transmission, means receiving said pulse signals at a remote point, pulse generator means producing in response to the first received pulse signal a controlled number of regularly recurrent pulses the periodicity of which is harmonically related to said timing wave, vacuum tube means responsive to the first of said recurrent pulses holding said receiving means operative only prior to the production of said first recurrent pulse, counter means responsive to said regularly recurrent pulses generating a second time wave harmonically related to said first timing wave and comprised of a controlled number of cycles, said counter means adapted to render said receiving means operative only in response to those of said cycles of said second timing wave defined by the arrival of said pulse signals which convey the intelligence of transmission and inoperative in response to the remaining cycles of said second timing wave, vacuum tube means counting the number of pulse signals conveying the intelligence of transmission, and means recording the count of last said vacuum tube means whereby the intelligence of transmission is reproduced.

3 Claims, 5 Drawing Figures

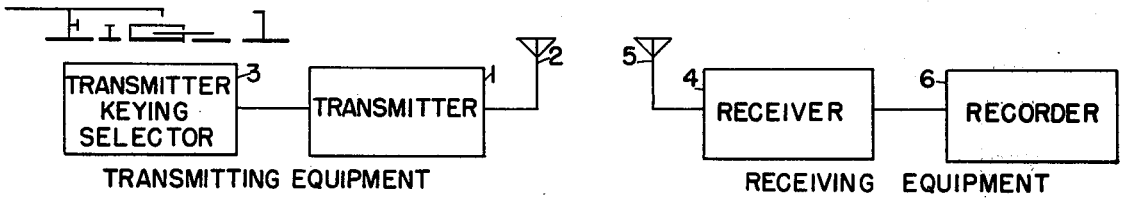
TRANSMITTER KEYING SELECTOR
3
TRANSMITTER
1
2
5
4
RECEIVER
6
RECORDER
TRANSMITTING EQUIPMENT
RECEIVING EQUIPMENT
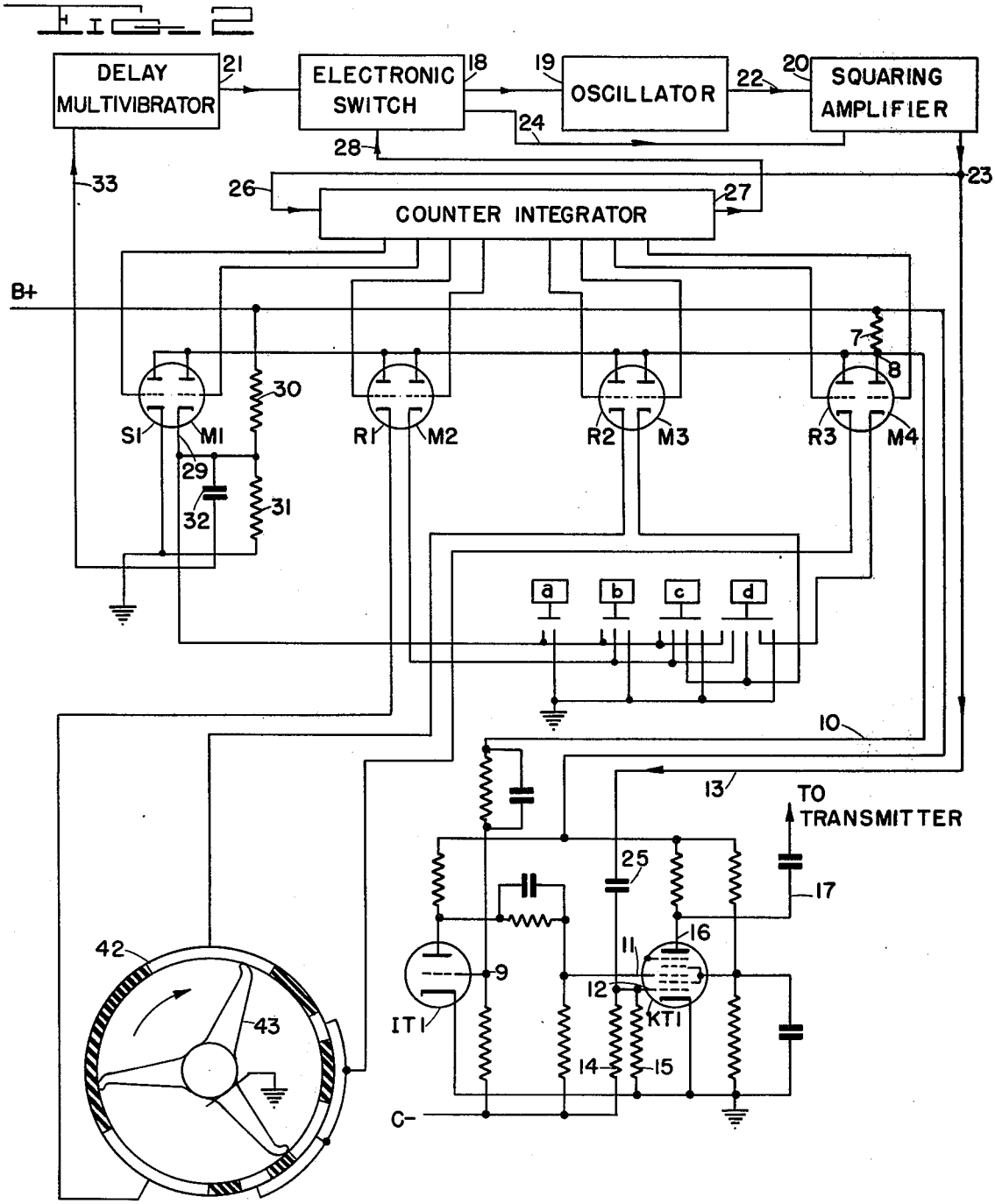
DELAY MULTIVIBRATOR
21
ELECTRONIC SWITCH
18
19
OSCILLATOR
22
20
SQUARING AMPLIFIER
24
28
33
26
27
23
COUNTER INTEGRATOR
B+
7
8
30
S1
M1
R1
M2
R2
M3
R3
M4
29
32
31
a
b
c
d
10
13
TO TRANSMITTER
25
17
16
11
42
9
12
43
IT1
KT1
14
15
C-

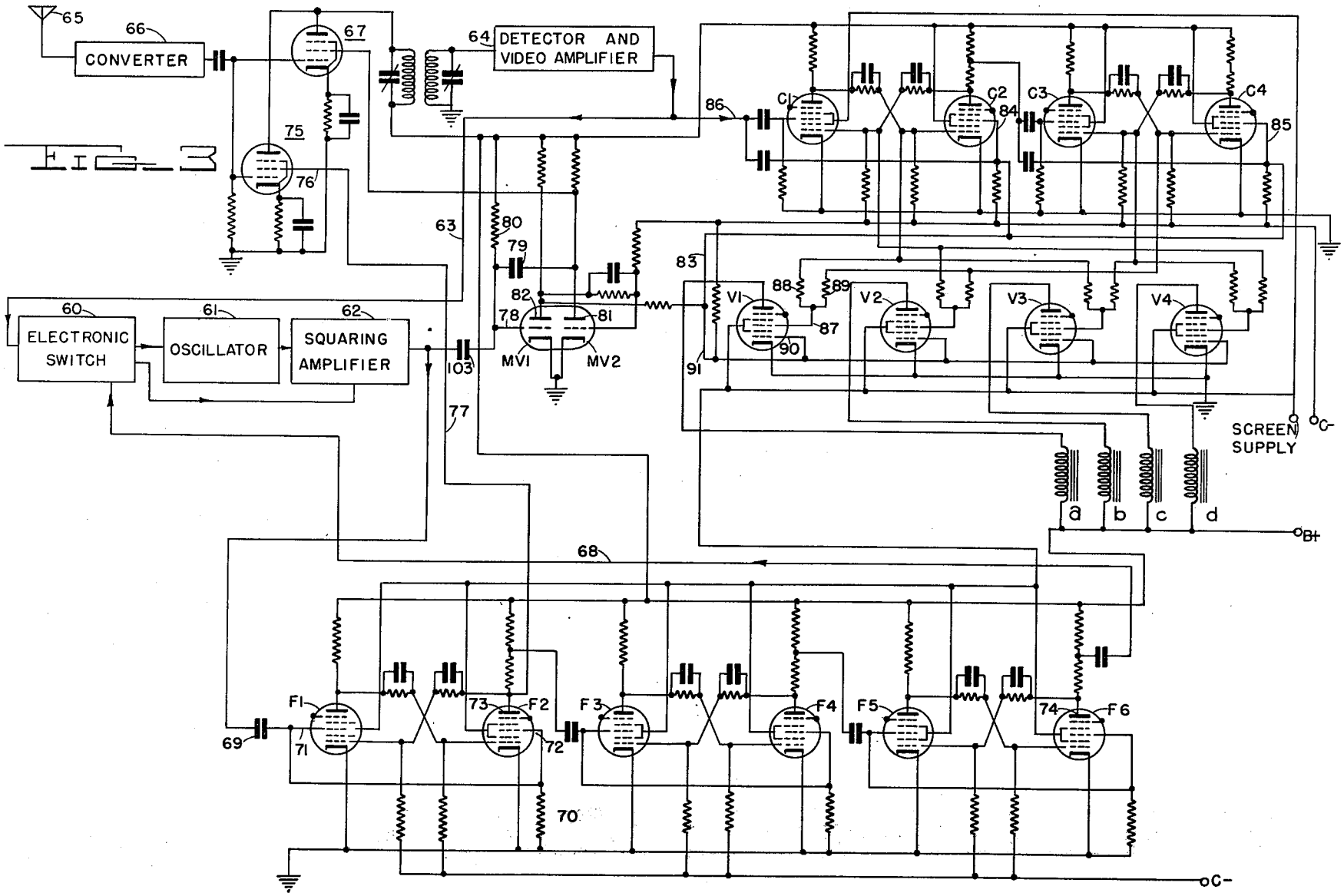
SCREEN SUPPLY
B+
C-
DETECTOR AND VIDEO AMPLIFIER
CONVERTER
SQUARING AMPLIFIER
OSCILLATOR
ELECTRONIC SWITCH

SECRET PULSE SIGNALING SYSTEM

The invention described herein may be manufactured and used by or for the Government of the United States of America for governmental purposes without the payment of any royalties thereon or therefor.

This invention relates broadly to a radio type intelligence transmission system and in particular to a radio pulse type signalling system wherein the time occurrence of the pulse signals is used both to convey and to dissemble the intelligence of the transmission.

In accordance with the teachings of this invention, a group comprising two or more electrical impulses is transmitted over a given time interval. The desired message is conveyed by those electrical impulses bearing a certain time relationship to the start of the transmission while other of the electrical impulses bearing a different time relationship serve to mask the intelligence so conveyed. The group structure, that is, the disposition of impulses in the group, may be altered according to the information it is desired to send and according to the disguise desired for that information. A timing device is employed at the transmitting source to provide a time pattern from which the group structure to be transmitted is formed and another timing device or plurality of timing devices is employed at the receiving end to provide a pattern into which the received group is fitted for translation into intelligence. The transmitter timing device and the receiver timing equipment are cooperative in their actions in that the operation of the latter is initiated in a definite time relation to the initiation of the operation of the former and the two generate time bases the unit intervals of which bear substantially constant and definite relationship to each other.

It is an object of this invention to provide a radio pulse type signalling system.

It is another object of this invention to provide a radio pulse type signalling system wherein the intelligence of a transmission is both conveyed and dissembled by the number and time occurrence of electrical impulses.

It is another object of this invention to provide a signalling system wherein the information transmitted may be rendered unintelligible to other than those for whom such information is intended.

Other objects and features of this invention will become apparent upon careful consideration of the following detailed description when taken together with the accompanying drawings in which:

FIG. 1 is a simplified block diagram of one embodiment of the invention;

FIG. 2 is a circuit diagram, partly in block and partly in detail of one component of the embodiment of FIG. 1;

FIG. 3 is a circuit diagram, partly in block and partly in detail of a second component of the embodiment of FIG. 1.

Figure 2A:
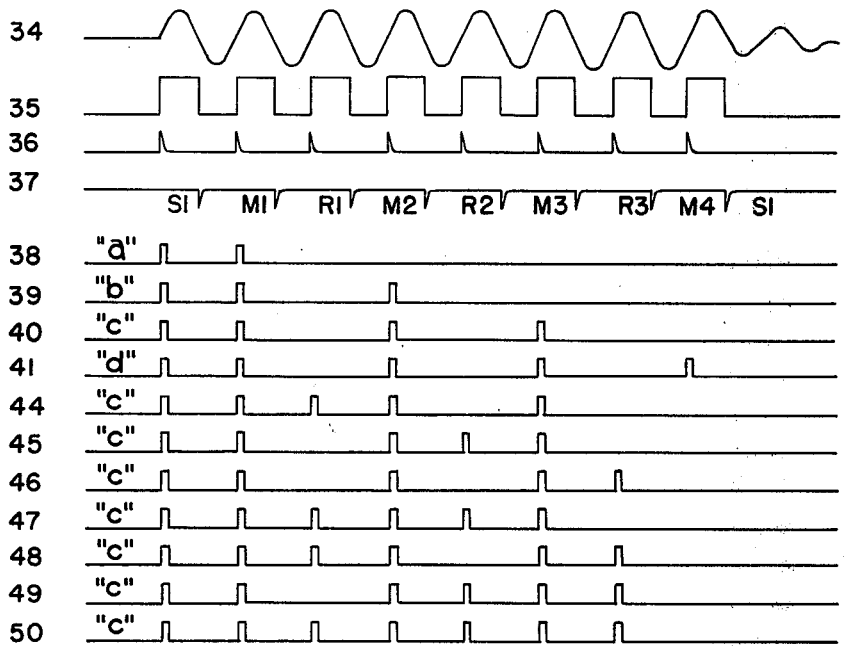
FIG. 2A is a series of waveforms useful in explaining the circuit of FIG. 2.

Reference is now had in particular to FIG. 1 wherein there is shown transmitting equipment and receiving equipment arranged to permit the transmission and reception of radio pulse signals in the manner taught by the invention. For purposes of illustration, the invention is here shown as a means of transmitting messages from one point to another, the point of reception being remote from the point of transmission, it being understood that there may be a plurality of such points of reception and that the point of reception may also include transmitting equipment and the point of transmission receiving equipment so that two way traffic may flow in the normal manner of radio communication. Transmitter 1 is preferably of the pulse emission type in which pulses or bursts of high frequency energy of extremely short time duration (5–10 microseconds) but high peak power are transmitted from antenna 2, which may be directional or omni-directional whichever is desired. The transmitter keying selector 3, the mode of operation of which is described in detail in copending application, Ser. No. 593,174, entitled "Pulse Signalling System" by Ernst H. Krause and Claud E. Cleeton, filed May 11, 1945, is in part a timing device which is arranged to key transmitter 1 in such a manner as to provide the desired pulse group structure. Receiver 4 is of the pulse reception type in which only those pulses of high frequency energy received on antenna 5 which convey information are subjected to final amplification and detection. The information contained in such useful pulses is registered by recorder 6 which may be a tape printing device or other suitable means of transcription.

As aforementioned, transmitter 1 is preferably of the high peak power type, which permits receiver 4 to be operated under conditions of low sensitivity, thereby minimizing the effect upon the receiver of interference signals originated by either natural or man-made sources. Further, transmitter 1 and receiver 4 may be suitably arranged to transmit and receive only pulses of a definite predetermined character as described in copending application, Ser. No. 582,966 entitled "Double Pulse Generator" by Claud E. Cleeton, et al, filed Mar. 15, 1945, thereby further reducing the possibility of interference.

Included in transmitter keying selector 3 but not shown, in FIG. 1 is, for example a keyboard of four push buttons, each of which corresponds to one of the four characters of the simple four character alphabet adopted for the purposes of this disclosure. As will be explained in the following paragraphs, an operator stationed at the transmitting equipment may operate this keyboard to select the number of pulses representing the character which he desires to send and transmitter keying selector 3 fits these pulses, together with automatically introduced masking pulses into a definite time pattern and keys the transmitter in accordance with this pattern. The pulse group thus transmitted is received by receiver 4, fitted into a time pattern generated by receiver 4, stripped of the masking pulses, counted and the count employed to actuate recorder 6.

In FIG. 2, transmitter keying selector 3 is shown partly in block diagram and partly in detail. Tube components S1, M1, M2, M3, M4, R1, R2, and R3 represent the vacuum tube elements of eight separate coincidence stages. When any one of these tubes is rendered conducting through coincidental grounding of its cathode (by closing any of the switches "a," "b," "c," or "d") and removal of grid bias (by the counter integrator 27 as hereinafter described) the flow of current through common plate resistor 7 causes a decrease in potential at point 8, the common juncture of the eight plate circuits. This decrease in potential, communicated to grid 9 of vacuum tube IT1 by lead 10, holds IT1 non-conducting for the duration of the coincidence mentioned above. While IT1 is held non-conducting, its plate potential is essentially B+ which is high enough to remove the bias from grid 11 of vacuum tube KT1 and permit it to conduct insofar as the action of grid 11 alone is concerned. On the other hand, and by a similar process, KT1 is rendered non-conducting by grid 11 during such times as anti-coincidence prevents the flow of current through resistor 7. First control grid 12 of KT1, in the absence of a positive signal applied to it via lead 13, is, by virtue of its connection to C- potential through resistance 14 and ground through resistance 15, at a potential which prevents plate current flow. Thus, for KT1 to be rendered conducting, a positive signal must reach grid 12 through lead 13 and grid 11 must be held at a positive potential by coincidence in one of the eight stages represented by the tubes S1 through M4. Whenever KT1 is thus rendered conducting, the negative signal which appears at plate 16 is applied through lead 17 to the transmitter (not shown) and keys it so as to cause the transmission of a pulse of high frequency energy.

Electronic switch 18, oscillator 19, and squaring amplifier 20 constitute a controllable pulse generator, the operation of which is described in the aforementioned Krause and Cleeton application. When electronic switch 18 is triggered by a negative signal from delay multivibrator 21, it renders oscillator 19 operable so that it feeds, through lead 22, a sine wave voltage which always starts at zero phase, proceeds in a positive direction on the initial excursion and reaches the same maximum amplitude on the first half cycle of the sine wave as characterizes succeeding cycles. Squaring amplifier 20 serves to amplify and square up the sine wave output from oscillator 20 so that there appears at point 23 a series of substantially rectangular positive pulses of time duration and spacing both equal to a half period of oscillator 19 frequency. If, for example, the frequency of oscillator 19 is chosen as 10 kilocycles per second, which is of the proper order for this embodiment of the invention, the duration and spacing of the rectangular pulses would each be 50 microseconds. In addition, electronic switch 18 operates through lead 24 to bias off squaring amplifier 20 during such times as oscillator 19 is held inoperative thus preventing the appearance of spurious signals at point 23.

The rectangular positive pulses appearing at point 23, after being differentiated by the low time constant circuit comprising capacitor 25 and resistor 14 are applied to grid 12 of KT1. The positive peak pulses of the differentiated output from amplifier 20 correspond to the leading edges of the rectangular positive signals and function to render KT1 conducting for a short interval of time (5–10 microseconds) insofar as the action of grid 12 alone is concerned. In this manner, if grid 11 of KT1 is held above cutoff by the action of IT1, KT1 will cause a pulse to be transmitted each time oscillator 19 starts a positive excursion.

The rectangular pulses appearing at point 23 are also applied, through lead 26 and a low time constant circuit (the latter not shown) to counter-integrator 27. Counter-integrator 27, the mode of operation of which is described in my copending application Ser. No. 582,964 entitled "Electronic Integrating System," filed Mar. 15, 1945, is designed to function only in response to negative signals which correspond to the trailing edges of the rectangular pulses appearing at point 23. In time, therefore, counter-integrator 27 is triggered one half period of oscillator 19 frequency later than KT1 is unbiased at grid 12. The function of counter-integrator 27, which comprises a three stage electronic counter having eight distinct states, is to remove the grid bias from the eight coincidence stages S1, M1, R1, M2, R2, M3, R3 and M4 in succession and in the order given each for a period of time equal to one period of oscillator 19 frequency. At the end of the period during which M4 has its grid bias removed, counter-integrator 27 applies, through lead 28, a signal to electronic switch 18 which triggers it so that oscillator 19 is rendered inoperable and no further rectangular pulses appear at point 23.

In practice, the operator of the transmission equipment, wishing to transmit the character "a" would press the push button "a" on his keyboard. This grounds cathode 29 of M1 which, prior to that time, had been held at a potential above ground established by the voltage divider consisting of resistors 30 and 31 connected between B+ and ground. The negative change in potential at cathode 29 is communicated to delay multivibrator 21 via capacitor 32 and lead 33 to initiate the delay period (which is of the order of 0.01 second) necessary to shield from electronic switch 18 any transient signals resulting from key bounce or stray inductance. The end of this delay period, which arrives after all such transients have disappeared, is characterized by delay multivibrator 21 applying a negative triggering signal to electronic switch 18 thus starting the cycle of operations which results in the appearance at point 23 of a series of eight rectangular positive pulses. Prior to the appearance of the first of these pulses, the grid of S1 is held above cutoff by counter-integrator 27 this condition being characteristic of the quiescent state of the circuit of FIG. 2. Thus, the leading edge of the first positive pulse arrives at grid 12 of KT1 to find KT1 unbiased at grid 11 (since S1 is conducting) and a pulse which may be designated at zero pulse is transmitted. The trailing edge of the first positive pulse output from amplifier 20 triggers counter-integrator 27 so that M1 is unbiased and therefore conducting for a period. During this period, the leading edge of the second positive pulse reaches grid 12 of KT1 and causes the transmission of a pulse which may be designated the "a" pulse. Ignoring momentarily the R1, R2 and R3 stages, it will be evident that no more pulses will be transmitted in this group since the cathodes of M2, M3 and M4 remain isolated from ground by the failure of the operator to press pushbuttons "b," "c" or "d." Thus a pulse group was transmitted which consisted only of the zero pulse and the "a" pulse separated in time by a single period of oscillator 19 frequency.

If the operator had chosen to press button "c," a pulse group would have been transmitted comprising four pulses, the zero pulse, after a single period delay, the "a" pulse, after a total delay of three periods, the "b" pulse and after a total delay of five periods of "c" pulse. Pulses "a" and "b" and "b" and "c" (and "c" and "d" as well) are separated in time by two periods rather than one by virtue of the fact that the conducting states of $R_1$ and $R_2$ and $R_3$ intervene. It is well to point out here that the delay period introduced by multivibrator 21 is far too short for the operator to have broken the contact of the particular character button pressed to initiate the transmission before counter-integrator 27 had gone through its complete cycle. This delay period is one of the order of 0.01 second and the counter-integrator cycle requires only seven and one half periods at the frequency of oscillator 19 (of the order of 750 microseconds).

In FIG. 2A, waveform 34, which is a plot of voltage against time, represents the sine wave output of oscillator 19. Waveform 35 represents the corresponding rectangular pulse output of squaring amplifier 20 and waveforms 36 and 37 represent the effective elements of the differentiated signals applied to grid 12 of KT1 and to counter-integrator 27 respectively. Between the negative triggers of wave form 37 which feed counter-integrator 27, has been indicated the particular coincidence stage which has the bias removed from its grid during that period. Waveform 38 represents the structure assumed by the pulse group when push button "a" of FIG. 2 is pressed. Waveforms 39, 40, and 41 similarly represent the pulse group structure assumed and transmitted when "b", "c" and "d", respectively are pressed.

Returning now to stages R1, R2 and R3, it will be seen that, had any of these been grounded during the transmissions of "a," "b," "c" or "d," additional intervening pulses would have been introduced into the pulse group transmissions. Commutator 42 is essentially a rotary switch, which driven by a motor (not shown), grounds the cathodes of R1, R2 and R3 in all the various possible combinations thereof. Commutator 42 also has insulated portions so arranged that for 15° of rotation none of these stages is grounded. This means that the structure of the transmitted pulse group is determined not only by the keyboard selection of the operator but also by the position of rotating triple contact 43 of commutator 42. The transmission of any of the letters "a," "b," "c" or "d" therefore can take eight different forms according to the position of contact 43 at the instant of transmission. For example, the letter "c" is transmitted without the introduction of any masking pulses as illustrated by waveform 40 and with masking pulses as illustrated in the seven waveforms 44 through 50. The masking pulses, by their presence or their absence provide each character of the four letter alphabet with eight different pulse group structures. If only the number of pulses comprising the group is considered, it will be seen that each of the four characters assumes group structures containing four different pulse members. For example, the groups representing "c" may contain four, five, six or seven pulses, while the groups representing "d" may contain five, six, seven or eight pulses.

Contact 43 of commutator 42 is caused to rotate during the operation of the transmission equipment at a rate such that keyboard operation does not reveal the pattern of the masking pulses. Thus, in dispatching a series of any one of the characters, the structure assumed by the masking pulses is not repeated in the same succession as the contact 43 transverses the commutator segments. This is accomplished by causing contact 43 to move through 15° of rotation at a rate greater than the rate at which the buttons of the keyboard are pressed. If the keyboard is operated at the nominal rate of 500 characters per minute, a rotational contact speed of 35 revolutions per minute will introduce a random characteristic into the masking pulse structure.

Since no transmission occurs during the delay period, the maximum transmitting time for any of the possible pulse groups would be that required for the character "d" which would involve seven and one half cycles of oscillator 19 or approximately 750 microseconds. If the transmitted pulses have a time duration of 5 microseconds, the character "d" would actually involve a transmitter emission time of from 25 microseconds to 40 microseconds depending upon the number of masking pulses. Similar figures for the character "a" for actual transmitter emission time are 10 and 25 microseconds.

Figure 3A:
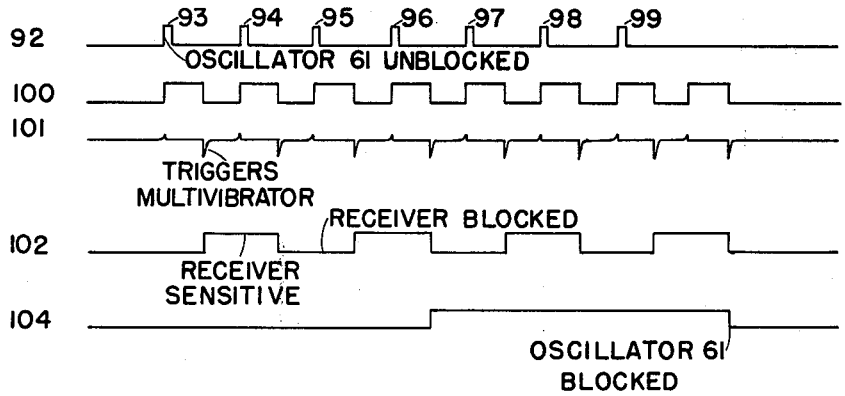
FIG. 3A is a series of waveforms useful in explaining the circuit of FIG. 3.

In FIG. 3, receiver 4 of FIG. 1 is shown partly in block and partly in detail. In general, this circuit comprises a time base generator which generates time intervals bearing a definite relationship to those which pattern the transmitted pulse group structure. The receiver time intervals are employed to hold the final stages of amplification and detection inoperative during the arrival time of any masking pulse and to hold the electronic counter which distinguishes between "a," "b," "c" and "d" inoperative during the arrival time of the zero or initial pulse. In particular, electronic switch 60, oscillator 61, and squaring amplifier 62 constitute a controllable pulse generator which is virtually identical with similar components of FIG. 2 in that the oscillator frequency is the same as that of oscillator 19 of FIG. 2 and the output of squaring amplifier 62 is a series of rectangular positive pulses having both spacing and duration equal to one half period at the frequency of oscillator 61.

A brust of high frequency energy received on antenna 65, converted to an intermediate frequency suitable for amplification by converter 66, amplified by I.F. stage 67 and subjected to final detection and video amplification by component 64 reaches electronic switch 60 through lead 63 in the form of the negative video envelope of the received burst. This negative envelope pulse triggers electronic switch 60 and thereby renders oscillator 61 operative. Any subsequent negative pulses applied to electronic switch 60 over lead 63 are impotent if they arrive at such a time as oscillator 61 is operating. The construction of electronic switch 60 is such that it is triggered into the state which holds oscillator 61 inoperative only by the application of a negative pulse through lead 68.

The rectangular positive pulse output from squaring amplifier 62 after being differentiated by the low time constant circuit comprising capacitor 69 and resistor 70 is employed to drive the three stage counter circuit of which F1, F2, F3, F4, F5 and F6 are the vacuum tube components. This counter circuit, which is conventional in its design and operation, is responsive only to negative signals arriving at parallel connected grids 71 and 72 of F1 and F2 respectively so that there is a count down factor of two per stage. This means that plate 73 of F2 is driven negative only once for every two input pulses to the counter and that eight such input pulses are required for each negative excursion of plate 74 of F6. Such a negative excursion at plate 74 is communicated through lead 68 to electronic switch 60 to render oscillator 61 inoperative as hereinbefore described. Since the right hand tubes in the first and second stages of the counter are driven into their conducting condition at the same time F6 conducts to produce the negative signal at plate 74, the counter is left in the same condition each time oscillator 61 is held quiescent. This condition consists of all right hand tubes, i.e., F2, F4 and F6 conducting and all left hand tubes, i.e., F1, F3 and F5 non-conducting.

When oscillator 61 is turned on by a signal received on antenna 65, the trailing edge of the first rectangular positive pulse from squaring amplifier 62 represents the first negative signal to the counter and causes F1 to conduct and F2 to be cutoff while the remaining counter tubes are unaffected. Thus, plate 73 of F2 first goes positive one half period at the frequency of oscillator 61 after the signal which initiates oscillator operation. It remains positive for one full period of the oscillator and is then driven negative so that there appears at plate 73 of F2 a series of rectangular pulses at a frequency half that of those appearing at the output of squaring amplifier 62. The duration and spacing of these rectangular pulses is two times that of the output of squaring amplifier 62 and the initial pulse is delayed in time one half period of oscillator 61 frequency after the initial pulse of squaring amplifier 62. I.F. amplifier stage 75, which parallels I.F. stage 67, is rendered operative only when screen 76 is raised to B+ potential through lead 77 from plate 73 of F2. I.F. stage 75 is therefore alternately operative and inoperative as determined by the rectangular voltage wave at plate 73 of F2. In the quiescent condition of the oscillator 61 and the counter circuit, F2 is conducting and I.F. stage 75 inoperative.

It will be seen from this that the first stage of the counter circuit in combination with oscillator 61 and squaring amplifier 62 form a time base generator in the receiver operating at a frequency one half that at which the time base generator in the transmitter equipment operates. It is this subharmonic relationship of frequencies of time base generation that demonstrates the teachings of this invention whereby the elements of a pulse group which constitute the disguise are stripped from the received transmission so as to reveal the original intelligence.

MV1 and MV2 represent the vacuum tube components of a conventional delay multivibrator such as that shown at 21 in FIG. 2, which has only one stable state of equilibrium (MV1 conducting and MV2 non-conducting) but which will maintain, upon receipt of a negative signal at grid 78 of MV1, a second state (MV1 non-conducting and MV2 conducting) for a definite interval of time which may be used for delay purposes as hereinafter described. The time interval for which the second state of the multivibrator can be maintained is determined by the time constant circuit formed by capacitor 79 and resistance 80. As MV1 and MV2 are driven into non-conduction and condution respectively to produce the delay period state of the multivibrator, the plate of MV2 is thereby driven sharply negative and holds grid 78 of MV1 below cutoff until capacitor 79 partially discharges through resistance 80. Multivibrator MV1 and MV2 is triggered out of its quiescent condition of stable equilibrium by the trailing edge of the first positive pulse from squaring amplifier 62. The same negative voltage at plate 81 of MV2 which holds MV1 cutoff for the delay period also cuts off I.F. stage 67 so as to render it inoperative for the delay period. It will be seen that stage 67 becomes inoperative coincidental with the beginning of the first period during which stage 75 is rendered operative. The positive voltage which appears at plate 82 of MV1 during the delay period is communicated through lead 83 to second control grids 84 and 85 of counter tubes C2 and C4 respectively so as to render those tubes capable of conducting insofar as the action of these grids alone is concerned.

The two stage scale-of-four counter circuit of which C1 and C2 comprise the first stage and C3 and C4 the second stage is driven by the output of detector and video amplifier stage 64 through lead 86. During the time that multivibrator MV1 and MV2 removes the bias from grids 84 and 85, the function of this two stage counter is to count the number of pulses reaching it from stage 64 and thereby distinguish between the alphabet characters "a," "b," "c" and "d."For this purpose the counter is integrated as taught by my copending application Ser. No. 582,964 entitled "Electronic Integrating System" filed Mar. 15, 1945. Voltage responsive means, comprising vacuum tubes V1, V2, V3 and V4 have their second control grids so connected through current limiting resistors, as typified by the connection of grid 87 through resistors 88 and 89, to the grid circuits of the counter that V1, V2, V3 and V4 are rendered conducting according to the number of pulses reaching the counter from stage 64. Another condition which must be satisfied before any of the V series tubes can conduct is that their first control grids, typified by grid 90 of V1, must be unbiased by multivibrator MV1 and MV2 through lead 91. It will be seen that, as multivibrator MV1 and MV2 starts its delay period and plate 82 of MV1 goes positive, the first control grids of all the V series tubes are unbiased coincidental with the unbiasing of second control grids 84 and 85 of C2 and C4. The flow of plate current in V1 is also through relay "a" so that it is energized when V1 is rendered conducting. Similarly, relay "b" is energized when V2 conducts, relay "c" when V3 conducts, and relay "d" when V4 conducts. In order for a relay to close, however, the V series tube to which it responds must conduct for a much greater length of time than is represented by the short interval (approximately 200 microseconds) during which it is unbiased by the counter as it changes from one of its four states to another. For this reason, the delay period of multivibrator MV1 and MV2 is made of the order of 0.05 second thereby permitting the V series tube which is conducting at the end of the received pulse group to stay in that state long enough for the mechanical relay which it controls to close. The closing of relay "a," "b," "c" or "d" causes that corresponding character to be registered in recorder 6 of FIG. 1 thereby completing the receipt and transcription of the intelligence conveyed by a pulse group.

The quiescent condition of the entire circuit of FIG. 3 to which it always returns after the receipt of a pulse group or, more specifically, after the delay period of multivibrator MV1 and MV2, is characterized by a number of conditions as follow: I.F. stage 67 is operative (since MV2 is cutoff and its plate potential is at B+); I.F. stage 75 is inoperative (since F2 is conducting and its plate potential is substantially ground); oscillator 61 is inoperative since it was rendered so by the change of F6 from non-conduction to conduction at the conclusion of the previous transmission; C1 and C3 are conducting and C2 and C4 non-conducting (since MV1 is conducting and its plate potential is essentially ground); the V series tubes are all cutoff (MV1 conducting); and none of the relays is closed.

Let it be assumed that the character "c" with the pulse structure represented by waveform 50 of FIG. 2A has been transmitted by transmitter 1 of FIG. 1. This pulse group is received on antenna 65 of FIG. 2 and converted to the intermediate frequency by converter 66. The envelope of this pulse group is shown as waveform 92 of FIG. 3A. Of this group, pulse 93 represents the zero pulse as hereinbefore described, pulses 94, 96 and 98 represent useful pulses in that they collectively convey the intelligence of transmission while pulses 95, 97 and 99 are random, masking pulses. Pulse 93, the zero pulse, arrives to find I.F. stage 67 operative and it is therefore detected and amplified by stage 64 and applied to electronic switch 60 through lead 63 and the scale-of-four counter circuit through lead 86. The counter does not respond, since C2 and C4 are held non-conducting by multivibrator MV1 and MV2. This pulse trips electronic switch 60, however, and oscillator 61 is activated so that squaring amplifier 62 begins its output of eight rectangular positive pulses represented by waveform 100 of FIG. 3A. These pulses, after peaking by input circuit capacitor 69 and resistor 70 are represented by waveform 101. The scale-of-eight counter responds to the negative peaks and there appears at plate 73 of F2 the series of rectangular pulses represented by waveform 102. It will be seen that the frequency of these pulses is one half that of oscillator 61 and therefore onehalf that of oscillator 19 of the transmitter equipment. The lower voltage level of waveform 102 corresponds to ground potential while the upper level corresponds to B+ so that I.F. stage 75 is rendered operative only during the intervals of time in which pulses 94, 96 and 98 of received pulse group arrive.

The output of squaring amplifier 62 is also applied to grid 78 of multivibrator MV1 and MV2. The trailing edge of the first positive pulse, after peaking by capacitor 103 and resistance 80, triggers the multivibrator into the delay period during which I.F. stage 67 is rendered inoperative, the scale-of-four counter is rendered operative and the V series of tube are rendered capable of conducting as determined by the counter $C_1$, $C_2$, $C_3$ and $C_4$. Subsequent pulses from squaring amplifier 62, also represented after peaking by waveform 101, have no effect upon multivibrator MV1 and MV2 since grid 78 is held below cutoff by the charge on capacitor 79.

Since neither I.F. stage 67 nor I.F. stage 75 is operative during the intervals in which pulses 95, 97 and 99 arrive, these random pulses are rejected and the pulse group is stripped of its disguise. Pulses 94, 96 and 98, however, reach stage 64 through I.F. stage 75 and send the counter through three states to the one in which C2 and C3 are conducting. This counter state unbiases V3 and relay "c" is energized and subsequently closes during the delay period of the multivibrator. The character "c" is therefore registered by recorder 6 of FIG. 1. The scale-of-eight counter continues to feed on the output of squaring amplifier 62 until plate 74 of F6 is driven negative at which time a negative signal is communicated to electronic switch 60 and oscillator 61 and squaring amplifier 62 are blocked. The voltage variations at the plate 74 of F6 are represented by waveform 104 of FIG. 3A. At the end of the delay period of MV1 and MV2, the V series tubes are again blocked, the counter $C_1$, $C_2$, $C_3$ and $C_4$ is reset to the state which will cause the relays to be closed in the proper order upon receipt of the next pulse group and I.F. stage 67 is unblocked ready for such a pulse group.

It will be seen that the receiver would have rejected any of the possible masking pulse structures inasmuch as the masking pulses arrive during intervals in which the subharmonic time generator in the receiver renders the receiver insensitive to all incoming signals.

To those versed in the art will occur a wide variety of applications of and variations in the teachings of this invention. One example of this is to increase the respective counters $C_1$ through $C_4$ and $F_1$ through $F_8$ stages until a full 26 letter alphabet with appropriate punctuation marks is provided. Another example is to provide a second keyboard in the transmitter so connected as to dispatch an entirely separate message from that dispatched by the first keyboard during the unit time intervals not utilized by the first keyboard. In simple form this would require that the random pulse commutator 42 of FIG. 2 be replaced by a three character keyboard and that the two keyboards be linked mechanically to provide for the joint use of the pulse group. At the receiver of FIG. 3, a third I.F. stage blocked and unblocked by the voltage at the plate of F1 rather than F2 of the frequency divider and followed by a separate detector and video amplifier stage would provide the input to an integrated counter and relay system substantially identical with that illustrated for the single keyboard embodiment. In this way, each message would provide the disguise for the other and since the circuits of FIG. 2 and FIG. 3 can be readily altered to provide these features, no separate drawings have been added. Still another example is to operate the receiver time generator at different subharmonic of the transmitter time base generator. Still another example is to employ a different type of time base generator such as a delay line, sawtooth generator, or conventional oscillator.

In certain applications, it may be of advantage to employ parallel channels in the video amplifier rather than as shown by FIG. 3, in the intermediate frequency amplifier in order to minimize the amplification given the transitory gating signals from the scale-of-eight counter. The "flash" signaling possibilities inherent in this system may be achieved by any of several well known methods so as to transmit and receive relatively long messages in very short intervals of time. For example, the mechanical relays recording means described herein could be replaced by suitable neon light indicators, the signals from which may be recorded photographically. This or a similar means makes it possible to transmit at an extremely rapid rate as from a tape controlled transmitter. To those versed in the art will occur such variations as phase modulation of the pulses within their respective time intervals in order to convey additional information or to heighten the secrecy of transmission.

Since certain further changes may be made in the foregoing construction and different embodiments of the invention may be made without departing from the scope thereof, it is intended that all matter shown in the accompanying drawings or set forth in the accompanying specification shall be interpreted as illustrative and not in a limiting sense.

What is claimed is:

1. A radio pulse signalling system comprising, oscillator means generating a first timing wave which is comprised of a controlled number of cycles, means transmitting a pulse signal at the start of said timing wave, means transmitting a selectable number of pulse signals in response to only certain of said cycles in said timing wave so as to thereby convey the intelligence of transmission, means transmitting a pulse signal in response to a random number of the remaining cycles in said timing wave so as to thereby dissemble the intelligence of transmission, means receiving said pulse signals at a remote point, pulse generator means producing in response to the first received pulse signal a controlled number of regularly recurrent pulses the periodicity of which is harmonically related to said timing wave, vacuum tube means responsive to the first of said recurrent pulses holding said receiving means operative only prior to the production of said first recurrent pulse, counter means responsive to said regularly recurrent pulses generating a second time wave harmonically related to said first timing wave and comprised of a controlled number of cycles, said counter means adapted to render said receiving means operative only in response to those of said cycles of said second timing wave defined by the arrival of said pulse signals which convey the intelligence of transmission and inoperative in response to the remaining cycles of said second timing wave, vacuum tube means counting the number of pulse signals conveying the intelligence of transmission, and means recording the count of last said vacuum tube means whereby the intelligence of transmission is reproduced.

2. In an electrical signaling system, means for generating a synchronizing signal at the start of a time interval composed of a finite number of successive periods, a first series of signals occurring during alternate ones of said successive periods and a second series of signals occurring during periods located between said alternate ones, a first plurality of coincidence means each including an electron tube having an anode, a cathode and a control element, means connected to said first plurality of coincidence means for applying a desired bias to selected ones of the electron tubes, means connected between said first mentioned means and said first plurality of coincidence means for applying each of said first series of signals to the control element of a respective one of the electron tubes thereby rendering the selected electron tubes operative to provide a third series of signals, a second plurality of coincidence means, each including an electron tube having an anode, a cathode and a control element, means connected to said second plurality of coincidence means for applying at random bias to the electron tubes, means connected between said first mentioned means and said second plurality of coincidence means for applying each of said second series of signals to the control element of a respective one of the electron tubes thereby rendering each electron tube having bias applied thereto operative to provide a fourth series of signals, means connected to said first mentioned means and to said first plurality of coincidence means and said second plurality of coincidence means for transmitting said synchronizing signal, said third series of signals and said fourth series of signals, receiving means for receiving the transmitted signals, and means connected to said receiving means and responsive to the synchronizing signal for rendering said receiving means operative during the time periods in which said third series of signals are received and inoperative during time periods in which said fourth series of signals would otherwise be received.

3. In an electrical signaling system, means for generating a synchronizing signal at the start of a time interval composed of a finite number of successive periods, a first series of signals occurring during alternate ones of said successive periods and a second series of signals occurring during periods located between said alternate ones, a first plurality of coincidence means each including an electron tube having an anode, a cathode and a control element, means connected to said first plurality of coincidence means for applying a desired bias to selected ones of the electron tubes, means connected between said first mentioned means and said first plurality of coincidence means for applying each of said first series of signals to the control element of a respective one of the electron tubes thereby rendering the selected electron tubes operative to provide a third series of signals, a second plurality of coincidence means, each including an electron tube having an anode, a cathode and a control element, means connected to said second plurality of coincidence means for applying at random bias to the electron tubes, means connected between said first mentioned means and said second plurality of coincidence means for applying each of said second series of signals to the control element of a respective one of the electron tubes thereby rendering each electron tube having bias applied thereto operative to provide a fourth series of signals, means connected to said first mentioned means and to said first plurality of coincidence means and said second plurality of coincidence means for transmitting said synchronizing signal, said third series of signals and said fourth series of signals, receiving means for receiving the transmitted signals, signal generating means connected to said receiving means and responsive to said synchronizing signals for generating a series of control signals, and means connected between said receiving means and said signal generating means for rendering said receiving means operative in response to alternate control signals and inoperative responsive to signals located between said alternate control signals.

* * * * *